United States Patent [19]

Wright

[11] Patent Number: 4,883,170

[45] Date of Patent: Nov. 28, 1989

[54] BALL GLOVE CONDITIONING BAG

[75] Inventor: Robert L. Wright, Des Moines, Iowa

[73] Assignee: Creative Athletic Products and Services, Inc., Des Moines, Iowa

[21] Appl. No.: 371,748

[22] Filed: Jun. 27, 1989

[51] Int. Cl.[4] ..... B65D 85/18; B65D 81/22

[52] U.S. Cl. ..... 206/315.1; 2/19; 8/94.23; 206/213; 206/278; 223/78; 239/55

[58] Field of Search ..... 206/205, 207, 213, 213.1, 206/278, 315.1, 315.9, 216; 2/19; 223/78, 80, 84; 8/94.21–94.23; 383/902; 239/53, 55

[56] References Cited

U.S. PATENT DOCUMENTS

| | | | |
|---|---|---|---|
| 1,462,906 | 7/1923 | Graeff | 206/315.1 |
| 1,648,657 | 11/1927 | Mock | 206/213.1 |
| 2,215,988 | 9/1940 | Virandov et al. | 239/55 |
| 2,270,603 | 1/1942 | Ridder | 206/205 X |
| 2,342,406 | 2/1944 | Latta et al. | 206/278 X |
| 3,706,140 | 12/1972 | Brilland et al. | 239/55 X |
| 4,061,170 | 12/1977 | Marks | 206/278 |
| 4,382,508 | 5/1983 | Robbins et al. | 206/216 |
| 4,418,849 | 12/1983 | Santa | 223/78 |
| 4,565,287 | 1/1986 | Rede et al. | 206/213 |
| 4,765,519 | 8/1988 | Groves | 223/78 |

*Primary Examiner*—Bryon P. Gehman

*Attorney, Agent, or Firm*—Zarley, McKee, Thomte, Voorhees & Sease

[57] ABSTRACT

Year round conditioning and shaping of a ball glove is accomplished through use of the conditioning bag which includes on its bottom wall straps which hold the glove in spaced relationship to the side walls which contain a foam liner containing conditioning oil. A conditioning fluid ball applicator is placed in the packet of the glove to shape the pocket and also transfer conditioning oil to the leather material in the pocket.

17 Claims, 2 Drawing Sheets

BALL GLOVE CONDITIONING BAG

BACKGROUND OF THE INVENTION

A baseball or softball glove will play like new and give many years of use if given proper care on a year round basis. The glove needs to be kept clean, soft and shaped to receive a ball. When the glove is not being used it should be stored in a fashion that its softness and shape will be restored such that it is ready for the next use.

Often the application of conditioning oils to the glove is done on an inconsistent basis. Over the winter months when the glove is not used it will usually be laid aside on a shelf in a closet and perhaps even flattened by other items being placed on top of it.

What is needed is a convenient inexpensive way of conditioning and storing the glove from day to day when being used and for longer periods of nonuse.

SUMMARY OF THE INVENTION

A bag is provided which has fastening means on the bottom wall for holding the glove centered in the bag chamber equally spaced from the upwardly converging side walls. A ball of foam material containing conditioning oil such as neat's-foot oil is placed in the glove and the fastening means is wrapped around the glove to shape the glove around the ball. Conditioning oil is transferred from the ball to the pocket of the glove.

The walls of the bag include a liner of foam material also containing conditioning oil which establishes a moist, oily environment in the chamber of the bag thereby treating the entire glove. The glove is preferably spaced from the side walls in order to avoid excess conditioning oil being applied to the backside of the glove and causing discoloration. Discoloration in the pocket is normal.

The fastening means in the bag chamber attached to the bottom wall are spaced apart and have hook-and-eye, velcro-type separable fasteners which are arranged in a figure 8 criss-cross fashion.

Containers for the neat's-foot oil and a cleaning fluid are provided in the bag in separate holders on the sidewalls. A pocket is provided on the outside of the bag for holding instructions on proper care for the glove.

DESCRIPTION OF THE PREFERRED EMBODIMENT

Figure 1:
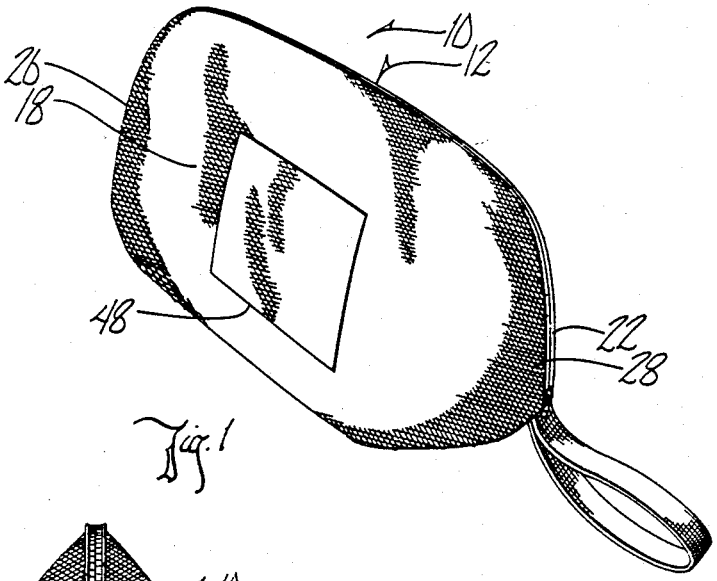
FIG. 1 is a perspective view of the ball glove conditioning bag.
Figure 2:
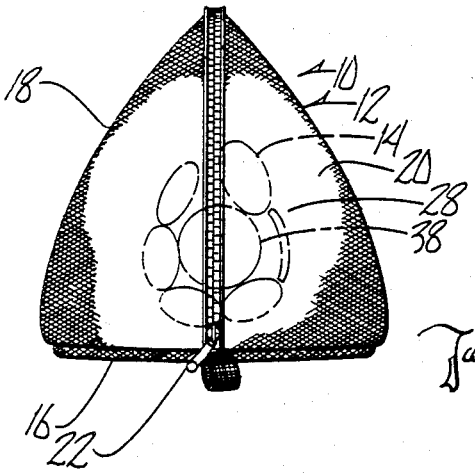
FIG. 2 is an end elevational view thereof from the right end of FIG. 1.
Figure 3:
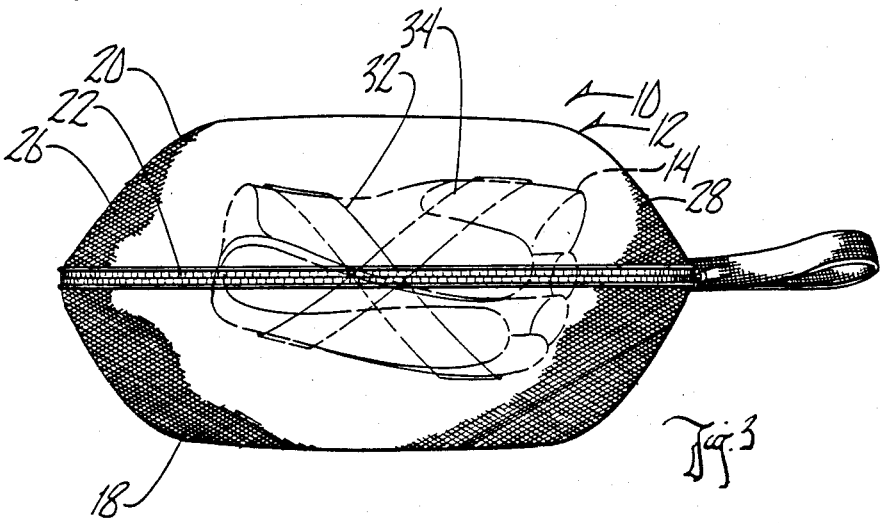
FIG. 3 is a top-plan view thereof.

The ball glove and glove conditioning bag of this invention is referred to generally in FIG. 1 by the reference numeral 10.

Figure 4:
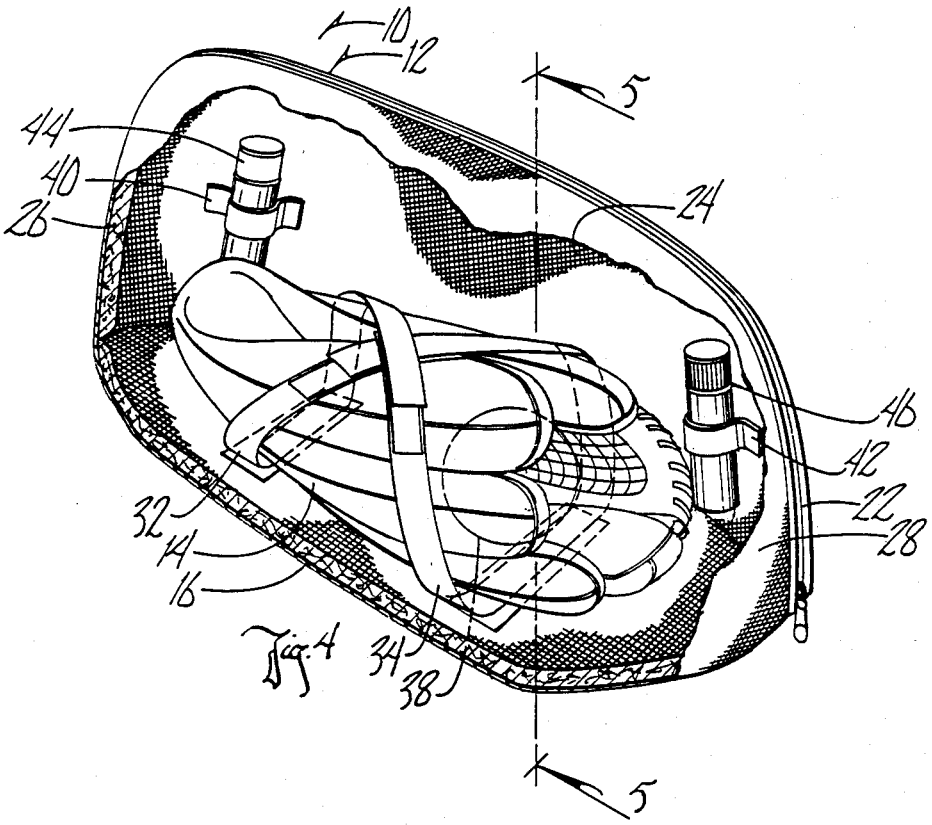
FIG. 4 is a fragmentary perspective view similar to FIG. 1 showing the glove being held in place inside the bag.
Figure 5:
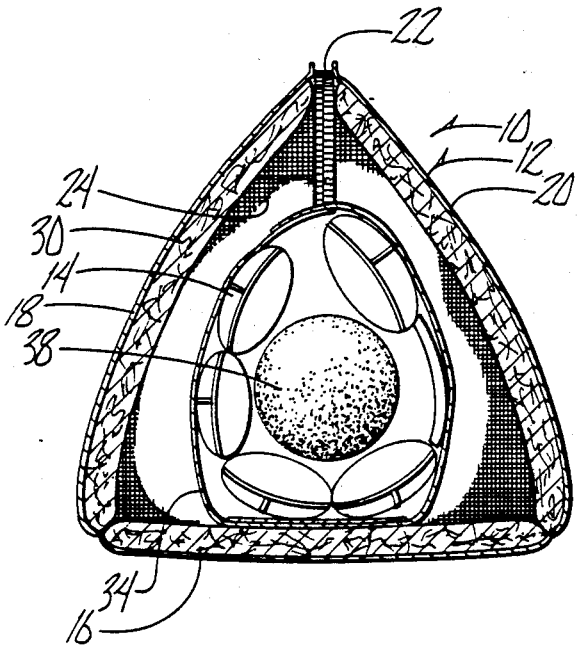
FIG. 5 is a cross-sectional view taken along line 5—5 in FIG. 4.

In FIG. 4 it is seen that a bag 12 is provided which contains a ball glove 14. The bag 12 has a bottom wall 16 and opposite side walls 18 and 20 which extend from the opposite sides of the bottom wall 16 and converge upwardly to a zipper closure 22 which extends the substantial length of the side walls and bottom wall to provide access into a chamber 24 in the bag 12. The converging side walls 18 and 20 also form end walls 26 and 28.

The walls of the bag each have an inside liner 30 of foam material which contains a conditioning oil such as neat's-foot.

A pair of spaced apart fastening straps 32 and 34 are secured to the bottom wall 16 and extend in a figure eight, criss-cross fashion around the glove 14 to hold it stationary and in substantial spaced relationship to the side walls.

An oil applicator ball 38 of foam material is positioned in the pocket of the glove whereby the straps 32 and 34, extending around the glove, shape the glove around the ball while at the same time transferring conditioning oil from the ball to the pocket of the glove. The conditioning oil in he foam liner 30 creates an oily environment in the chamber 24 and serves to keep the entire glove soft and pliable. Direct contact with excessive oil is avoided on the backside of the glove by keeping it spaced from direct contact with the side walls. This way discoloration of the backside of the glove will be avoided while it is normal on the front or pocket side of the glove. It may be desirable not to provide oil in the foam on the bottom wall 16 on which the glove is placed.

The side wall 18 on the inside face, as seen in FIG. 4, contains at opposite ends straps 40 and 42 for holding containers of oil and cleaning fluid 44 and 46 respectively. A pocket 48 is provided on the outside of the bag as seen in FIG. 1 for holding an instruction book on care of a ball glove through use of the conditioning bag of this invention.

It is thus seen in operation that the bag 12 of this invention provides a simple, inexpensive but effective way to care for a ball glove on a daily basis in between uses of the glove or for extended periods of time when the glove is not being used.

I claim:

1. A ball glove and glove conditioning bag comprising, a bag having a chamber defined by a bottom wall and side walls, and an access opening into said bag, a ball glove in said chamber, fastening means in said bag for holding said glove stationary and substantially centered between said side walls, a conditioning fluid applicator ball in the pocket of said glove, and said fastening means holding said glove in a wrapped-around-said-ball relationship whereby conditioning fluid may be transferred from said ball to said glove.

2. The structure of claim 1 wherein said fastening means is secured to said bottom wall and said glove is secured to said bottom wall face up.

3. The structure of claim 2 wherein said fastening means is further defined as being hook-and-eye type interlocking separable straps secured to said bottom wall and extending around said glove and ball.

4. The structure of claim 3 wherein said straps include two spaced apart straps secured to said bottom wall.

5. The structure of claim 4 wherein said two straps are interconnected around said glove in a figure eight criss-cross fashion.

6. The structure of claim 1 wherein said bag side walls include a conditioning fluid which is emitted into said chamber whereby the entire glove is conditioned.

7. The structure of claim 6 wherein the conditioning fluid in said side walls is contained in a foam inner liner.

8. The structure of claim 6 wherein said conditioning fluid in said ball is neat's-foot oil.

9. The structure of claim 8 wherein said conditioning fluid in said side walls is neat's-foot oil.

10. The structure of claim 6 wherein said bottom wall includes said conditioning fluid.

11. The structure of claim 1 wherein said conditioning fluid in said ball is neat's-foot oil.

12. The structure of claim 1 wherein said side walls of said bag converge upwardly from said opposite sides of said bottom wall and meet to form a top wall including said access opening which includes a closure means.

13. The structure of claim 12 wherein said side walls in converging upwardly to form said top wall also form opposite end walls.

14. The structure of claim 13 wherein said closure means extends the length of said side walls, top wall and between said end walls to substantially said bottom wall at its opposite ends.

15. The structure of claim 1 and holding mean is provided in said bag for a container of conditioning fluid.

16. The structure of claim 15 and holding means is provided in said bag for a container of cleaning fluid.

17. The structure of claim 1 wherein a pocket is provided on the outside of said bag for an instruction booklet.

* * * * *